US011214079B2

(12) United States Patent
Kawarada

(10) Patent No.: US 11,214,079 B2
(45) Date of Patent: Jan. 4, 2022

(54) PRINTING APPARATUS

(71) Applicant: Masaya Kawarada, Kanagawa (JP)

(72) Inventor: Masaya Kawarada, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 17/110,313

(22) Filed: Dec. 3, 2020

(65) Prior Publication Data

US 2021/0187970 A1 Jun. 24, 2021

(30) Foreign Application Priority Data

Dec. 18, 2019 (JP) ..... JP2019-228372

(51) Int. Cl.
*B41J 11/00* (2006.01)

(52) U.S. Cl.
CPC ..... *B41J 11/0015* (2013.01); *B41J 11/002* (2013.01)

(58) Field of Classification Search
CPC ..... B41J 11/0015; B41J 11/002
See application file for complete search history.

(56) References Cited

U.S. PATENT DOCUMENTS

2018/0244038 A1* 8/2018 Ziegenbalg ..... B41F 19/007

FOREIGN PATENT DOCUMENTS

| | | |
|---|---|---|
| JP | 2011-063001 | 3/2011 |
| JP | 2014-024224 | 2/2014 |
| JP | 2015-058606 | 3/2015 |
| JP | 2016-163998 | 9/2016 |
| JP | 2019-019315 | 2/2019 |

* cited by examiner

*Primary Examiner* — Justin Seo
(74) *Attorney, Agent, or Firm* — Xsensus LLP

(57) ABSTRACT

A printing apparatus includes a coater, a first discharger, a first dryer, a second discharger, and a second dryer. The coater applies a coating liquid to both faces of a sheet material. The first discharger discharges a first liquid to one face of the sheet material with the coating liquid applied to both faces of the sheet material. The first dryer dries the sheet material to which the first liquid discharged from the first discharger is applied. The second discharger discharges a second liquid to the other face of the sheet material that has passed through the first dryer. The second dryer dries the sheet material to which the second liquid discharged by the second discharger is applied.

5 Claims, 6 Drawing Sheets

PRINTING APPARATUS

CROSS-REFERENCE TO RELATED APPLICATIONS

This patent application is based on and claims priority pursuant to 35 U.S.C. § 119(a) to Japanese Patent Application No. 2019-228372, filed on Dec. 18, 2019, in the Japan Patent Office, the entire disclosure of which is incorporated by reference herein.

BACKGROUND

Technical Field

Aspects of the present disclosure relate to a printing apparatus.

Related Art

Generally, there is an apparatus that applies treatment liquid to both faces of a sheet material with a coating device and performs printing on the sheet material.

SUMMARY

In an aspect of the present disclosure, there is provided a printing apparatus including a coater, a first discharger, a first dryer, a second discharger, and a second dryer. The coater applies a coating liquid to both faces of a sheet material The first discharger discharges a first liquid to one face of the sheet material with the coating liquid applied to both faces of the sheet material. The first dryer dries the sheet material to which the first liquid discharged from the first discharger is applied. The second discharger discharges a second liquid to the other face of the sheet material that has passed through the first dryer. The second dryer dries the sheet material to which the second liquid discharged by the second discharger is applied.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
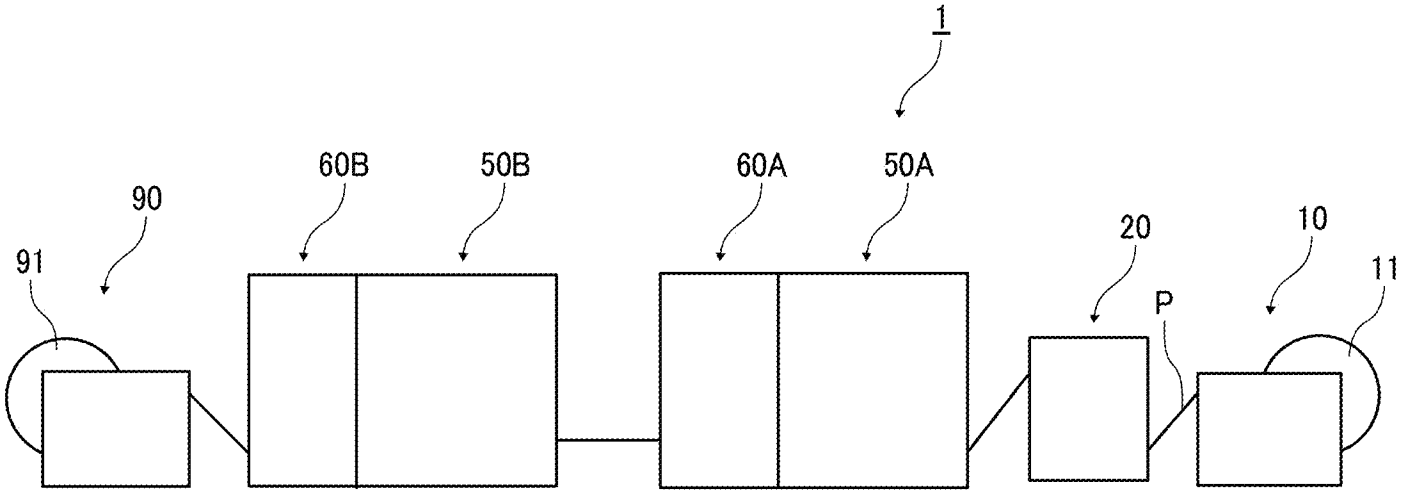
FIG. 1 is a schematic view illustrating a printing apparatus according to a first embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity.

However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below.

First, a printing apparatus according to a first embodiment of the present disclosure is described with reference to FIG. 1. FIG. 1 is a schematic view illustrating the printing apparatus according to the first embodiment of the present disclosure.

The printing apparatus 1 includes an unwinding device 10, a coating device 20, a first discharge device 50A, a first drying device 60A, a second discharge device 50B, a second drying device 60B, and a winding device 90.

The unwinding device 10 is a carry-in unit to unwinding and carrying in a sheet material P, which is a web such as continuous form sheet, from an original winding roller 11. The coating device 20 is a pre-treatment unit to apply treatment liquid as coating liquid on both sides of the sheet material P conveyed from the unwinding device 10.

The first discharge device 50A is a printing unit including a first discharger to discharge and print liquid containing colorant on one face of a sheet material P coated with the treatment liquid on both faces of the sheet material by the coating device 20. The first drying device 60A is a drier to heat and dry the sheet material P on which the liquid is discharged by the first discharge device 50A.

The second discharge device 50B is a printing unit including a second discharger to discharge and print liquid containing colorant on the other face of the sheet material P heated in the first drying device 60A. The second drying device 60B is a drier to heat and dry the sheet material P on which the liquid is discharged by the second discharge device 50B.

The winding device 90 is a carry-out unit to wind the sheet material P, which is dried by passing through the second drying device 60B, onto the winding roller 91.

Figure 2:
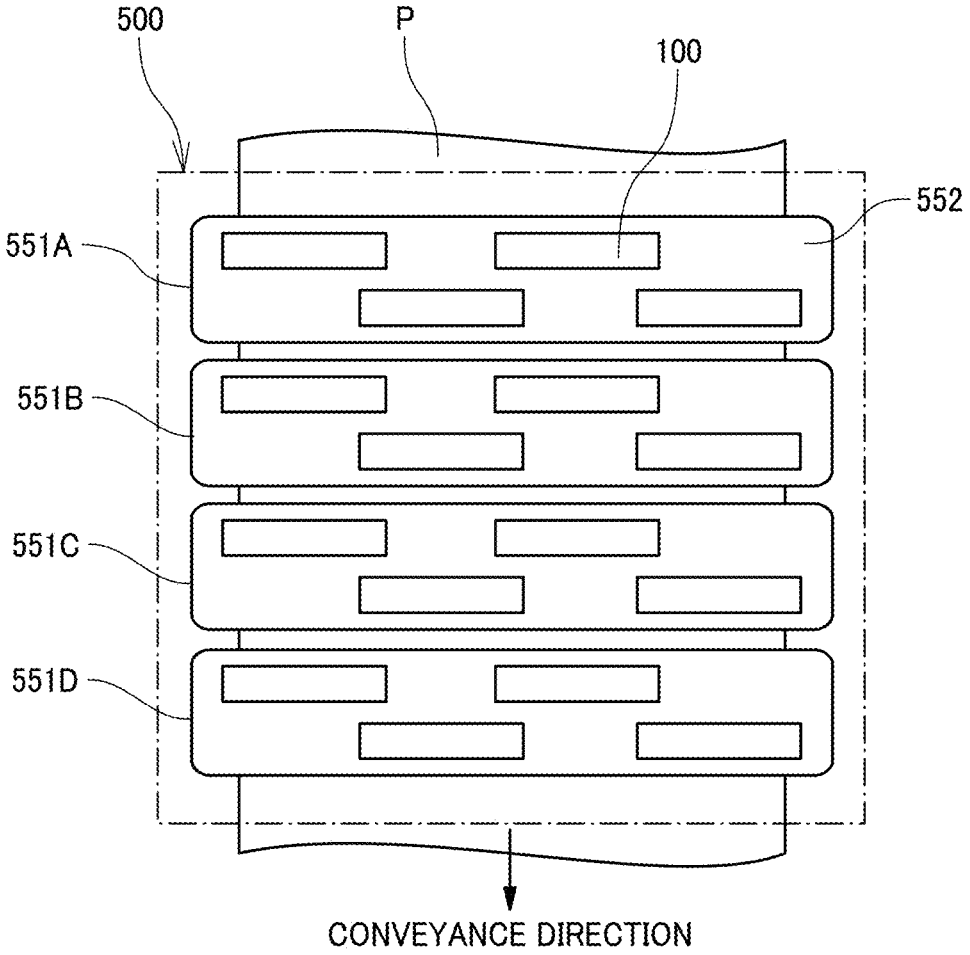
FIG. 2 is an illustration of an example of a discharger of each of a first discharge device and a second discharge device.

Next, an example of the first discharge device 50A and the second discharge device 50B is described with reference to FIG. 2. FIG. 2 is an illustration of the discharger of each of the above-described discharge devices.

Each of the first discharge device 50A and the second discharge device 50B includes a discharger 500. The discharger 500 of the first discharge device 50A is referred to as a first discharger, and the discharger 500 of the second discharge device 50B is referred to as a second discharger.

In the discharger 500, full-line type head arrays 551A, 551B, 551C, and 551D for four colors (hereinafter referred to as "head array 551" when colors are not distinguished), are arranged from the upstream side in a conveyance direction of a sheet material P.

Each head array 551 is a liquid discharger and discharges liquid of black (K), cyan (C), magenta (M), or yellow (Y) to the sheet material P to be conveyed. Note that the type and number of color are not limited to the above-described four colors.

The head array 551 includes, for example, liquid discharge heads (which are also simply referred to as "heads") 100 arranged in a zigzag manner on a base member 552. However, the arrangement of heads is not limited to such arrangement.

Figure 3:
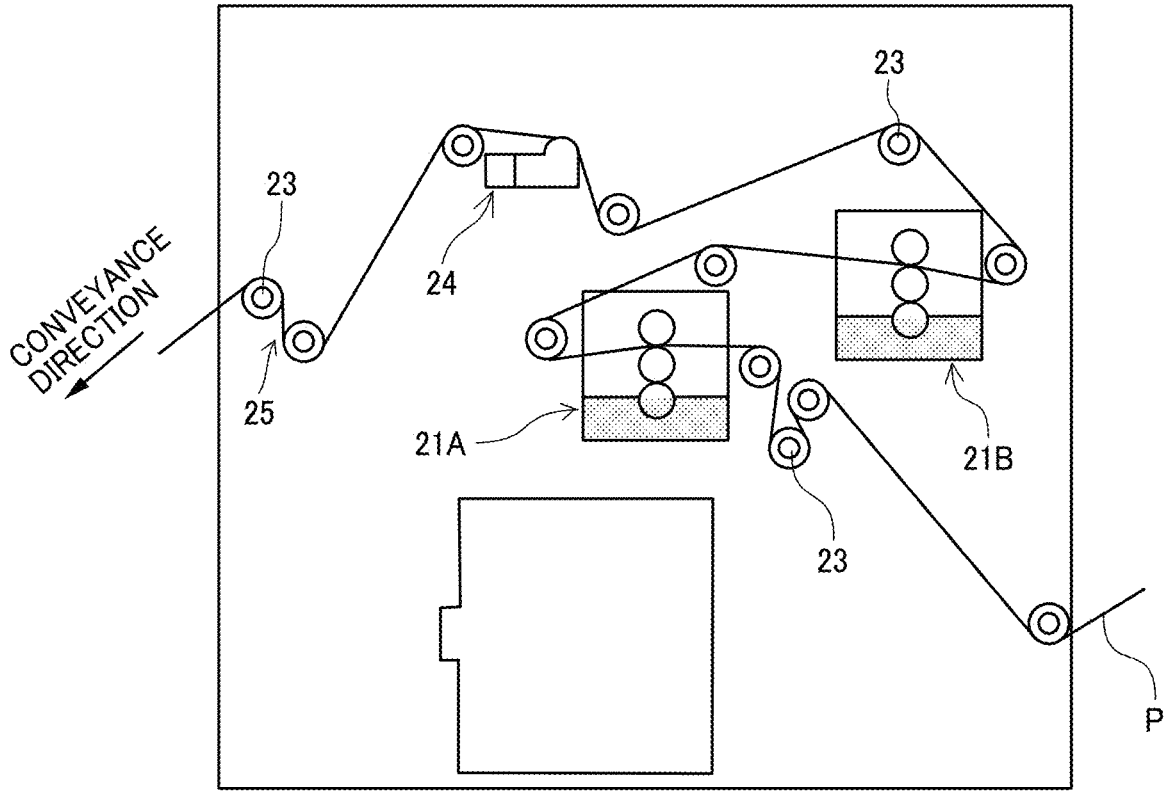
FIG. 3 is an illustration of an example of a coating device.

Next, an example of the coating device 20 is described with reference to FIGS. 3 and 4. FIG. 3 is an illustration of the coating device 20, and FIG. 4 is an illustration of a coater of the coating device 20.

The coating device 20 includes a first coater 21A, a second coater 21B, a plurality of guide rollers 23, a cutter mechanism 24, and so forth. Furthermore, the coating device 20 has an S-shaped conveyance path 25 immediately upstream from an outlet in the conveyance direction of the sheet material P to enhance the running stability of the sheet material P.

The first coater 21A is a treatment liquid applicator to apply treatment liquid 201 as coating liquid on one face (front face) of the sheet material P being conveyed. The second coater 21B is a treatment liquid applicator to apply the treatment liquid 201 on the other face (back face) of the sheet material P.

Figure 4:
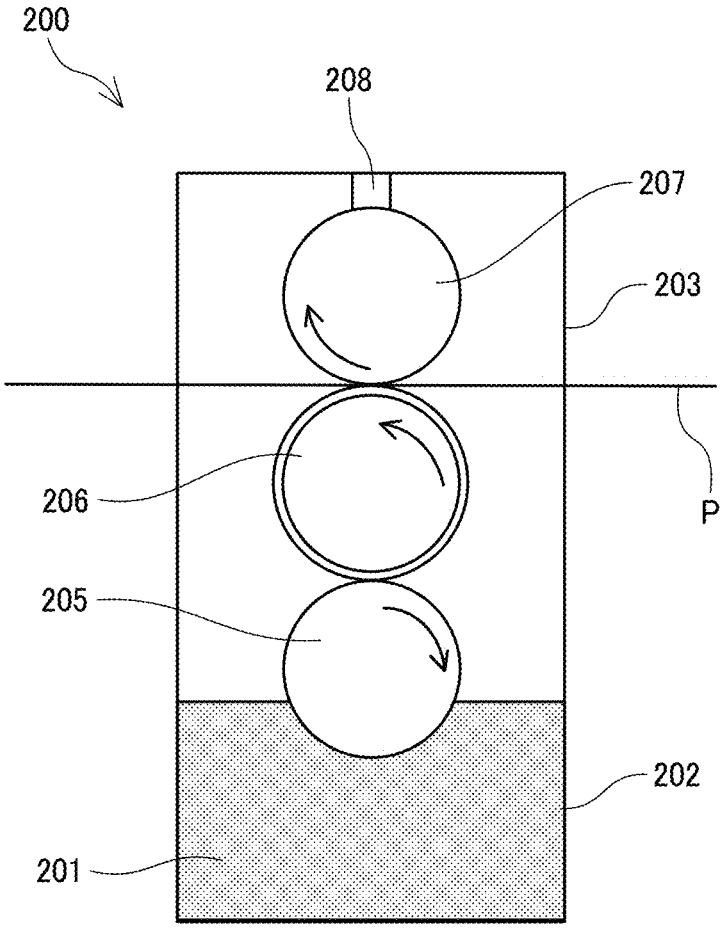
FIG. 4 is an illustration of a coater of the coating device.

The first coater 21A and the second coater 21B are configured with a coater 200 illustrated in FIG. 4.

The coater 200 includes a treatment liquid container 202 to contain the treatment liquid 201. The treatment liquid container 202 may be integrated with a case member 203 that is a housing of the coater 200.

The coater 200 includes a transfer roller 205 and a coating roller 206. The transfer roller 205 is accommodated in the treatment liquid container 202 to scoop the treatment liquid 201. The coating roller 206 applies the treatment liquid 201 to the sheet material P after the treatment liquid 201 is transferred onto the coating roller 206 by the transfer roller 205. The transfer roller 205 is rotated at a speed slightly slower than the conveyance speed of the sheet material P.

Further, the coater 200 includes a pressure roller 207 to press the sheet material P facing the coating roller 206 and a pressure adjusting device 208 to adjust the pressing pressure of the pressure roller 207.

In the coater 200, the transfer roller 205 transfers the treatment liquid 201 onto the surface of the coating roller 206 in the shape of a thin film.

Then, the coating roller 206 is pressed against the rotating pressure roller 207 to rotate the coating roller 206. At this time, the coater 200 conveys the sheet material P into a gap between the coating roller 206 and the pressure roller 207 to apply the treatment liquid 201 onto the surface of the sheet material P.

The pressure adjusting device 208 controls the nip pressure arising when the treatment liquid 201 is applied to the sheet material P (i.e., the pressure acting at a position where the coating roller 206 and the pressure roller 207 are in contact with each other). The applied amount (application amount, film thickness, liquid amount, adhesion amount, dry adhesion amount, etc.) of the treatment liquid 201 can be adjusted by changing the nip pressure using the pressure adjusting device 208.

Further, the applied amount of the treatment liquid 201 can be also controlled by changing the rotational speeds of the coating roller 206 and the pressure roller 207.

A liquid of which the agglutination reaction with the ink does not change significantly in either a wet state or a dry state, is used as the treatment liquid 201. For example, a pre-coating liquid as described in JP-2019-019315-A may be used.

Figure 5:
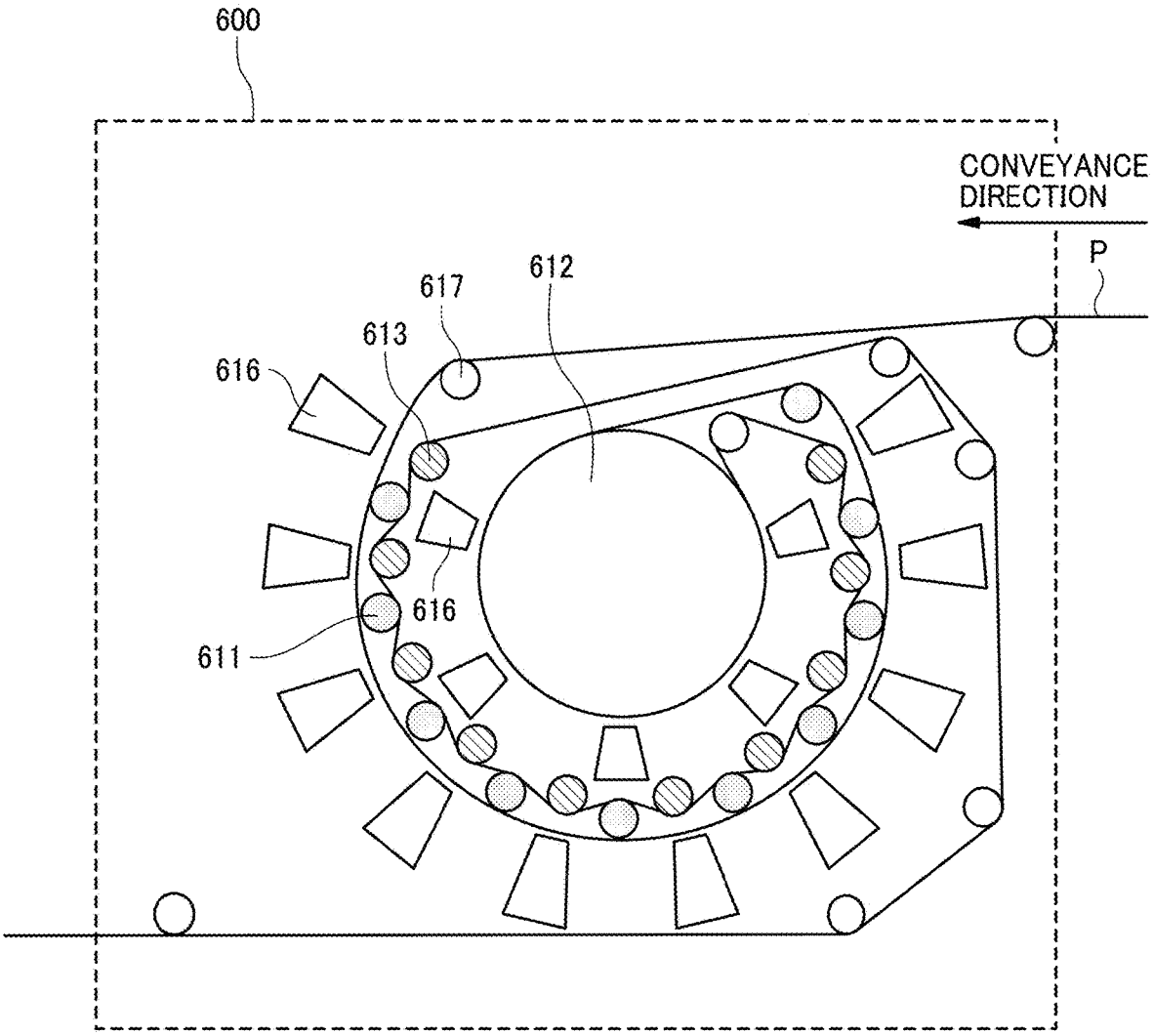
FIG. 5 is an illustration of an example of a drier including a first drying device and a second drying device.

Next, an example of the drier constituting each of the first drying device and the second drying device is described with reference to FIG. 5. FIG. 5 is an illustration of the drier of each of the above-described drying devices. Note that, in FIG. 5, the rotating bodies having the same function are indicated with the same hatch or dot pattern, and the reference numerals are omitted.

Each of the first drying device 60A and the second drying device 60B includes a drier 600. The drier 600 of the first drying device 60A is referred to as a first drier, and the drier 600 of the second drying device 60B is referred to as a second drier.

The drier 600 includes a plurality of heating rollers 611 and a heating drum 612 to heat a sheet material P in contact with the sheet material P. Further, the drier 600 includes a plurality of guide rollers 613 to guide the sheet material P so that the sheet material P contacts necessary heating rollers 611 among the plurality of heating rollers 611.

A heating conveyance path (or a conveyance path) for heating the sheet material P is configured by the plurality of heating rollers 611, the heating drum 612, and the plurality of guide rollers 613. The sheet material P is conveyed while contacting the outer peripheral side of the plurality of heating rollers 611 arranged in an arc shape on the upstream side of the heating drum 612 in the conveyance direction of the sheet material P. Then, the sheet material P passes through the heating drum 612, and is conveyed by the guide roller 613 while contacting the inner peripheral side of the plurality of heating rollers 611.

In other words, in the present embodiment, the sheet material P is brought into contact with the heating roller 611 from different directions and heated by the heating rollers 611.

Further, in the drier 600, a plurality of non-contact heating units 616 that heats the sheet material P from a liquid applied face side are arranged on the outer peripheral side of the arrangement of the plurality of heating rollers 611, and a plurality of non-contact heating units 616 are also arranged around the heating drum 612. The non-contact heating unit 616 can be configured with, for example, an air blowout unit or an infrared (IR) heater. Note that, in the present embodiment, "liquid applied face" refers to a face on which liquid has been applied by discharge of the discharger 500 of the first discharge device 50A or the second discharge device 50B.

Further, the drier 600 includes a plurality of guide rollers 617 that guides the sheet material P to carry the sheet P into and out the drier 600.

As the flow of a drying process in the drier 600 thus configured, the non-contact heating units 616, for example, blow air to the liquid applied face to heat the liquid applied face, while the opposite face of the liquid applied face of the sheet material P is brought into contact with and heated by the heating rollers 611.

Then, the non-contact heating units 616, for example, blow air to the liquid applied face to heat the liquid applied face, while the opposite face of the liquid applied face of the sheet material P is brought into contact with and heated by the heating drum 612, which is disposed inside the arrangement of the plurality of heating rollers 611.

Thereafter, while the guide rollers 613 are brought into contact with the liquid applied face of the sheet material P, the heating rollers 611 contact the face opposite to the liquid applied face of the sheet material P and heats the sheet material P to dry the liquid applied to the sheet material P.

At this time, the treatment liquid 201 applied to both faces of the sheet material P by the coating device 20 is also dried, and the treatment liquid 201 is in a dry state.

As above described, the printing apparatus 1 includes the coating device 20 including the first coater 21A and the second coater 21B, each of which is configured with the coater 200 that applies the coating liquid (treatment liquid 201) on both faces of the sheet material P.

The printing apparatus 1 further includes the first discharge device 50A and the first drying device 60A. The first discharge device 50A receives the sheet material P, in which the treatment liquid 201 is applied on both faces by the coating device 20, as it is and discharges liquid to one face of the sheet material P. The first drying device 60A dries the sheet material P applied with the liquid in the first discharge device 50A.

Further, the printing apparatus 1 includes the second discharge device 50B and the second drying device 60B. The second discharge device 50B discharges liquid to the other face of the sheet material P having passed through the first drying device 60A. The second drying device 60B dries the sheet material P applied with the liquid which is discharged in the second discharge device 50B.

Thus, in the printing apparatus 1, the coating liquid is applied to both faces of the sheet material P, the liquid is discharged to the sheet material P conveyed to the first discharge device 50A, which is the first discharger, without being heated, and then printing and drying are performed. As a result, the coating liquid applied to the sheet material P and the printing liquid applied in the first discharge device 50 are dried. Thereafter, the liquid is discharged in the second discharge device 50B, which is the second discharger, on the other face of the sheet material P, and then printing and drying are performed.

In other words, there is no means for heating the sheet material P between the coating device 20, which is the coater, and the first discharge device 50A, which is the first discharger. The first drying device 60A, which is the first drier, is disposed between the first discharger and the second discharger.

In other words, the printing apparatus 1 has the following configuration: the coating liquid is applied, liquid is discharged from the first discharge device 50A serving as the first discharger to the sheet material P, which is not heated. The coating liquid is applied in the coater, and then liquid is discharged from the second discharge device 50B, which is the second discharger, to the sheet material P which is heated.

Further, the first discharge device 50A, which is the first discharger, discharges the liquid to the sheet material P in a wet state, and the second discharge device 50B, which is the second discharger, discharges the liquid to the sheet material P on which the coating liquid is in a dry state.

As a result, the sheet material P, to which the coating liquid is applied and the printing liquid is discharged by the first discharger, is prevented from being sent to the second discharger and applied further liquid in an undried state, and thus print quality is enhanced.

Further, since the coating device 20 does not include a drying section to dry a sheet material P on which the treatment liquid is applied on both faces, the height of the coating device 20 can be restrained to be lower than the height of the first discharge device 50A.

Figure 6A:
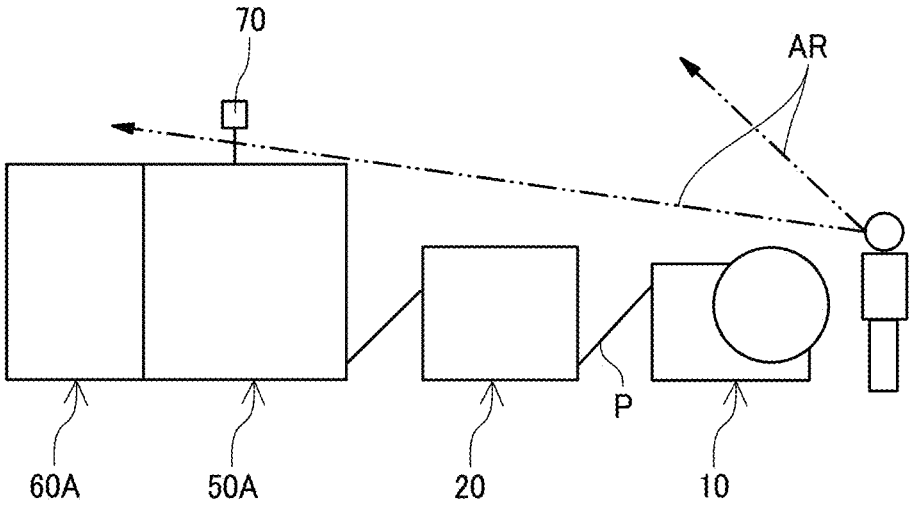
FIGS. 6A and 6B are illustrations of operation of the printing apparatus.

As a result, as illustrated in FIG. 6A, a field of view AR is prevented from being disturbed by the coating device 20 when viewed from the upstream side of the unwinding device 10 along the conveyance direction of the sheet material P, and a rotating lamp (revolving warning light) 70 disposed above the first discharge device 50A is visible.

Figure 6B:
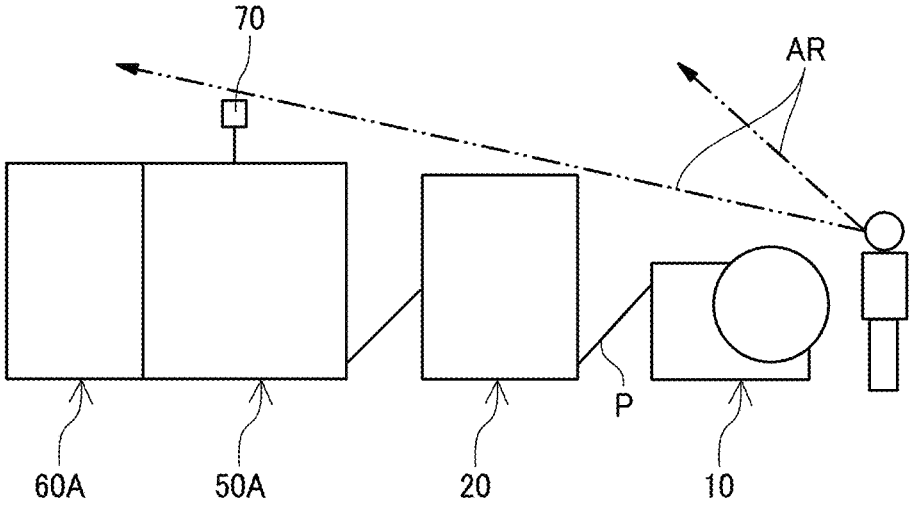

On the other hand, as illustrated in FIG. 6B, when the height of the coating device 20 is high, the field of view AR is blocked by the coating device 20, and the rotating lamp 70 disposed above the first discharge device 50A is invisible.

In the above-described embodiment, the example of the printing apparatus 1 that performs printing on a web-shaped sheet material is described. However, a printing apparatus in an embodiment of the present disclosure is not limited to such a printing apparatus and may be, for example, a printing apparatus that performs printing on a cut sheet or a large-format cut sheet such as a wallpaper.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

The invention claimed is:

1. A printing apparatus comprising:

a coater configured to apply a coating liquid to both faces of a sheet material;

a first discharger configured to discharge a first liquid to one face of the sheet material with the coating liquid applied to both faces of the sheet material;

a first dryer configured to dry the sheet material to which the first liquid discharged from the first discharger was applied;

a second discharger configured to discharge a second liquid to the other face of the sheet material that has passed through the first dryer; and a second dryer configured to dry the sheet material to which the second liquid discharged by the second discharger was applied, wherein the first discharger is configured to discharge the first liquid to the sheet material that has been applied with the coating liquid by the coater and has not been heated, and the second discharger is configured to discharge the second liquid to the sheet material that has been applied with the coating liquid by the coater and has been heated.

2. The printing apparatus according to claim 1, wherein the sheet material conveyed from the coater to the first discharger is not heated, and the first dryer is between the first discharger and the second discharger.

3. A printing apparatus comprising:

a coater configured to apply a coating liquid to both faces of a sheet material;

a first discharger configured to discharge a first liquid to one face of the sheet material with the coating liquid applied to both faces of the sheet material;

a first dryer configured to dry the sheet material to which the first liquid discharged from the first discharger was applied;

a second discharger configured to discharge a second liquid to the other face of the sheet material that has passed through the first dryer; and a second dryer configured to dry the sheet material to which the second liquid discharged by the second discharger was applied, wherein the first discharger is configured to discharge the first liquid to the sheet material in a wet state, and the second discharger is configured to discharge the second liquid to the sheet material in a dry state.

4. The printing apparatus according to claim 1, further comprising:

a coating device including the coater; and a discharge device including the first discharger, wherein a height of the coating device is lower than a height of the discharge device.

5. The printing apparatus according to claim 3, further comprising:

a coating device including the coater; and a discharge device including the first discharger, wherein a height of the coating device is lower than a height of the discharge device.

* * * * *